US009682304B2

(12) United States Patent
Vilhelmsen

(10) Patent No.: US 9,682,304 B2
(45) Date of Patent: Jun. 20, 2017

(54) GOLFER'S ARM SWING CONTROL KIT AND METHOD

(71) Applicant: Kurt Vilhelmsen, Buckley, WA (US)

(72) Inventor: Kurt Vilhelmsen, Buckley, WA (US)

( * ) Notice: Subject to any disclaimer, the term of this patent is extended or adjusted under 35 U.S.C. 154(b) by 0 days.

(21) Appl. No.: 15/049,736

(22) Filed: Feb. 22, 2016

(65) Prior Publication Data

US 2016/0243424 A1 Aug. 25, 2016

Related U.S. Application Data

(60) Provisional application No. 62/118,925, filed on Feb. 20, 2015.

(51) Int. Cl.
*A63B 69/36* (2006.01)
*A63B 69/00* (2006.01)

(52) U.S. Cl.
CPC ..... *A63B 69/3608* (2013.01); *A63B 69/0059* (2013.01); *A63B 69/3623* (2013.01)

(58) Field of Classification Search
USPC ..... 473/207, 212, 215, 276, 409
See application file for complete search history.

(56) References Cited

U.S. PATENT DOCUMENTS 4,783,092 A * 11/1988 Kandal ..... A63F 9/30 273/412
5,590,884 A * 1/1997 Goldberg ..... A63B 67/086 473/514
6,932,713 B1 * 8/2005 Kim ..... A63B 69/3608 473/227
2005/0049068 A1 * 3/2005 Chang ..... A63B 69/3608 473/276
2008/0153615 A1 * 6/2008 Baird ..... A63B 69/3608 473/207
2014/0336019 A1 * 11/2014 Villella ..... A63B 21/072 482/106

* cited by examiner

*Primary Examiner* — Nini Legesse
(74) *Attorney, Agent, or Firm* — Dean A. Craine

(57) ABSTRACT

A golfer's swing arm control kit including two straight rigid sticks each configured to be placed in a front to back direction under a golfer's armpit and held in the armpit with the upper arm pressing inward against the sides of the golfer's upper torso adjacent to the chest when performing a golf swing. Also disclosed is a method for training arm control when swinging a golf club, comprising the steps of selecting the two straight sticks each stick placed in a front to back direction under a golfer's armpit and held in the armpit by pressing the upper arm inward against the sides of the golfer's chest or upper torso; holding each stick in place under the armpit by pressing the upper arm against the side of the chest or upper torso; and, performing a golf swing while pressing the upper arms against the chest or upper torso.

1 Claim, 2 Drawing Sheets

GOLFER'S ARM SWING CONTROL KIT AND METHOD

This utility patent application is based on and claims the filing date benefit of U.S. Provisional Patent Application (Application No. 62/118,925) filed on Feb. 20, 2015.

Notice is given that the following patent document contains original material subject to copyright protection. The copyright owner has no objection to the facsimile or digital download reproduction of all or part of the patent document, but otherwise reserves all copyrights.

BACKGROUND OF THE INVENTION

1. Field of the Invention

This invention pertains to training tools for golfers, and more particular to training tools that help golfers properly execute a golf swing.

2. Description of the Related Art

When executing a golf swing, it is important that the face of the club head be oriented correctly when it contacts the golf ball so that the golf ball travels in the desired arc and in a straight line towards the target. When the swing is properly executed, only the waist, shoulders and arms should rotate during the swing so that the face of the golf club opens on the backswing, perpendicularly aligned with the ball path when the face of the golf club contacts the ball, and then closes in the forward swing. During the swing, axial rotation of the forearms and wrists should be restricted but not prevented altogether. Also, the upper arms should be held inward and pressed lightly against the sides of the upper torso throughout the swing. The shoulders should still allow the upper arms to swing slightly inward and outward during the backswing and front swing, respectively. Determining the proper positions and movements of both arms and controlling the movements of the arms throughout the swing is difficult.

What is needed is a simple teaching aid that helps a golfer to determine the proper positions of the arms and the correction amount of rotation of each arm when swinging a golf club.

SUMMARY OF THE INVENTION

Disclosed herein is a simple, yet effective golf swing training kit that helps a golfer determine the correct initial positions of the arms and the movement of the arms relative to the upper torso when swinging a golf club. The kit includes two straight sticks configured to be held comfortably under the golfer's arm pits when swinging a golf club. The stick's longitudinally axes are substantially parallel with when standing upright and aligned in front to back direction. The two sticks are held under the armpits throughout the entire golf swing by pressing the upper arms and elbows inward and tightly against the sides of the upper torso during the golf swing. While holding the upper arms inward against the sides of the upper torso, the golfer's elbows and forearms are extended slightly forward from the golfer's upper torso enabling the golfer to rotate his or her waist when performing a backswing and forward swing. If during a swing one or both sticks fall from the armpits, the golfer knows that upper arms and elbows were not properly held against the sides of the upper torso throughout the swing. If during a swing, both sticks are held on the armpits but the golf club did not move smoothly in swing arch, upper arms and elbows are held too tight against the sides of the upper torso. With practice, the golfer learns how to supply the correct about of pressure to the upper arms and elbows to hold the sticks in place but also allow the golfer to move the golf club through the swing arch smoothly.

In some instances, the sticks can be conveniently stored in the golf bag and used just before playing a round of golf to refresh his muscle memory on how to properly perform a golf swing.

DESCRIPTION OF THE PREFERRED EMBODIMENT(S)

Figure 1:
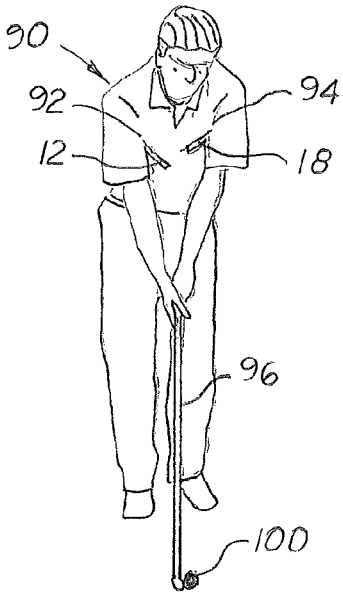
FIG. 1 is a front elevational view of a golfer holding a golf club and standing adjacent to a golf ball with two sticks held under the golfer's two armpits.
Figure 2:
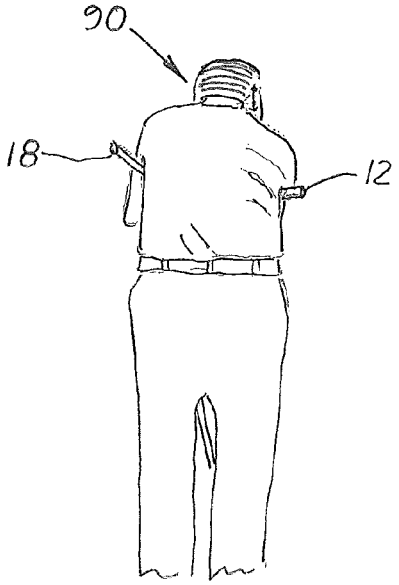
FIG. 2 is rear elevational view of the golfer shown in FIG. 1.
Figure 3:
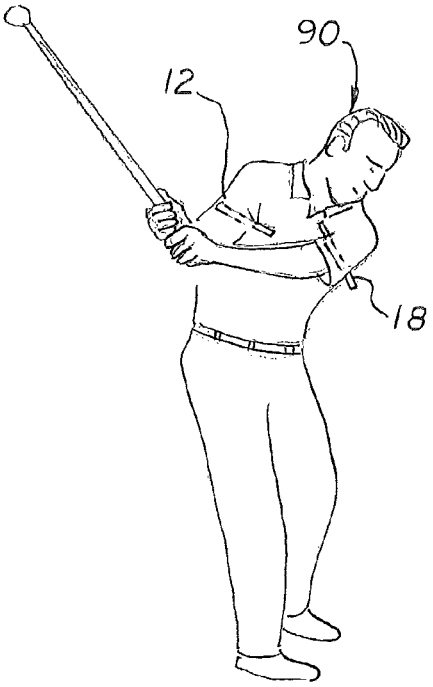
FIG. 3 is a left side elevational view of a golfer performing a backswing while holding the upper arms and elbows inward and adjacent to the upper torso thereby holding the two sticks under the two armpits during the backswing.
Figure 4:
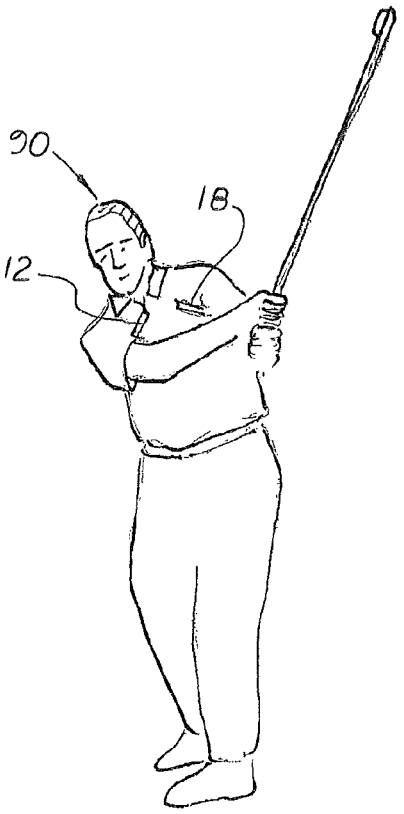
FIG. 4 is a right side elevational view of a golfer performing a forward swing while holding the upper arms and elbows inward and adjacent to the upper torso thereby holding the two sticks under the two armpits during the forward swing.
Figure 5:
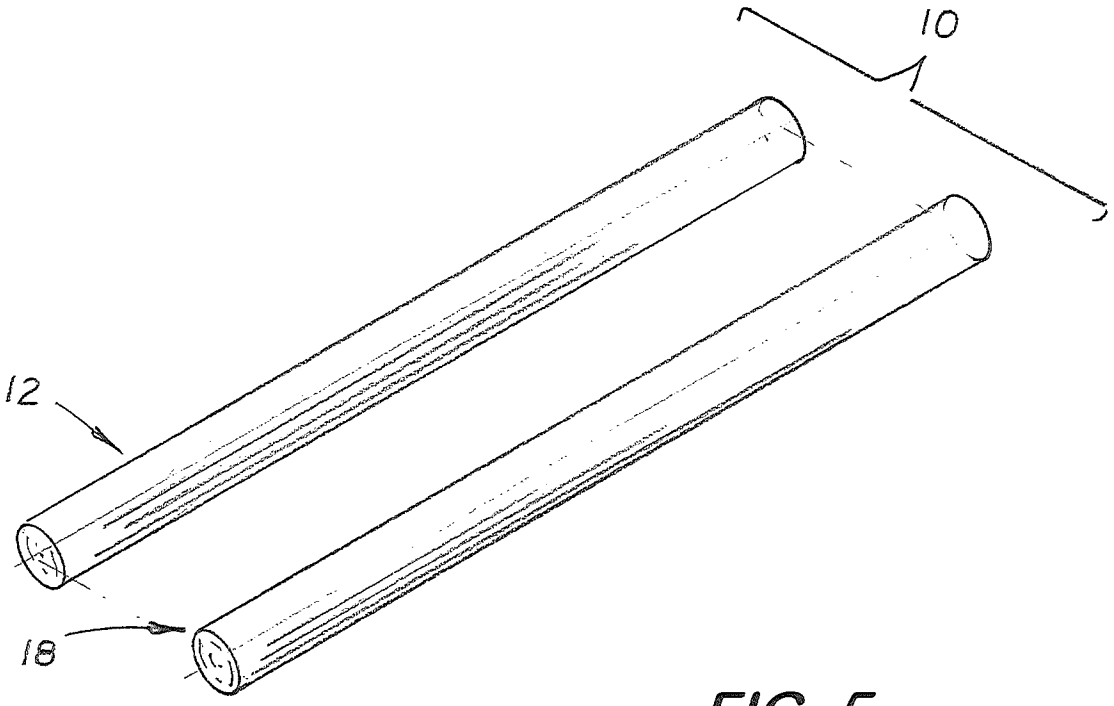
FIG. 5 is a perspective view of the kit showing two sticks.

A golfer's swing arm control kit 10 that includes two straight rigid sticks 12, 18 as shown in FIG. 5, each stick 12, 18 is configured to be placed in a front to back direction under a golfer's armpit 92, 94 and held in the armpit 92, 94 with an golfer's upper arm 92, 94, respectively, pressing inward against the sides of the golfer's upper torso 91 when performing a golf swing.

FIGS. 1-4 show a golfer 90 with two sticks 12, 18 positioned under the golfer's two armpits 92, 94 holding a golf club 96 against a golf ball 100.

In the embodiment shown herein, the arm sticks 12, 18 are identical and measure ½ to 1 inch in diameter and 8 to 18 inches in length. Each stick 12, 18 may be a uniform solid rod or tube. The sticks 12, 18 are made of thermoplastic (e.g. PVC), fiberglass, rubber or wood. It should be understood, the sticks 12, 18 may be straight or substantially straight with a slight curve. They may be rigid or semi-rigid.

The method for teaching a proper golf swing comprises the following steps: selecting the two straight sticks 12, 18 each stick is placed in a front to back direction under a golfer's armpit 92, 94 and held in the armpit 92, 94 by pressing the golfer's upper arms pressing inward against the sides of the golfer's upper torso 91 when performing a golf swing; and, performing a golf swing with the golf club 96 while pressing the upper arms against the upper torso 91 to prevent the sticks 12, 18 from falling from the armpits 92, 94.

In compliance with the statute, the invention described has been described in language more or less specific as to structural features. It should be understood however, that the invention is not limited to the specific features shown, since the means and construction shown, comprises the preferred embodiments for putting the invention into effect. The invention is therefore claimed in its forms or modifications within the legitimate and valid scope of the amended claims, appropriately interpreted under the doctrine of equivalents.

I claim:

1. A method for practicing swinging of a golf club by a golfer using two arms that continuously force said arms inward against said golfer's upper torso when swinging said golf club, said method comprising the following steps:

a. said golfer standing upright adjacent to a golf ball located on a tee or on the ground;

b. selecting two straight sticks each configured to extend transversely in a front to back orientation along opposite sides of an upper torso and under an armpit, each said stick also configured to be held under said armpit when sufficient inward pressure is applied by an arm adjacent to said armpit and automatically fall from said armpit when insufficient inward pressure is applied to said stick by said adjacent arm, said sticks each being 8 to 18 inches in length and ½ to 1 inch in diameter;

c. positioning one of said sticks in a front to back direction under each said armpit on opposite side of said upper torso, and continuously applying sufficient inward force using said arm against said upper torso to hold said stick against said upper torso and under said armpit and prevent said stick from falling;

d. gripping said golf club with two hands; and, e. performing a golf swing with said golf club that includes a backswing and a forward swing while continuously pressing said arms inward to continuously hold said sticks against said upper torso when swinging said golf club.

* * * * *